United States Patent [19]

Müeller

[11] 3,938,484

[45] Feb. 17, 1976

[54] VALVE STEM RETAINER

[75] Inventor: Reinhard Müeller, Lauenau Copenbrugger, Germany

[73] Assignee: Teves-Thompson GmbH, Germany

[22] Filed: May 20, 1974

[21] Appl. No.: 471,185

[52] U.S. Cl. ... 123/90.67; 123/188 C; 123/188 GC; 123/188 VA

[51] Int. Cl.[2] ..... F01L 3/10

[58] Field of Search ..... 123/90.67, 188 C, 188 P, 123/188 VA, 188 GC, 189

[56] References Cited

UNITED STATES PATENTS

| | | | |
|---|---|---|---|
| 2,171,668 | 9/1939 | Oldham | 123/90.67 |
| 2,694,391 | 11/1954 | Ohly | 123/90.67 |
| 2,844,134 | 7/1958 | Sietman | 123/90.67 |
| 2,855,915 | 10/1958 | Norton | 123/90.67 |

*Primary Examiner*—Wendell E. Burns
*Assistant Examiner*—Daniel J. O'Connor
*Attorney, Agent, or Firm*—Hill, Gross, Simpson, Van Santen, Steadman, Chiara & Simpson

[57] ABSTRACT

A valve stem retainer provides improved frictional engagement between the retainer segments and the valve stem. The retainer includes a pair of retainer lock segments, each of the segments having a radius of curvature less than the radius of curvature of the valve stem on which the segments are installed. The segments are expanded by deformation elastically into conformity with the valve stem and when so installed, provide tight frictional engagement with the valve stem. The segments define, in a first position on the valve stem, a pair of diametrically opposed gaps along a portion of the periphery of the valve stem. For the improved results of the present invention, it was found that the ratio of the width of the pair of gaps to the radius of the valve stem should be carefully controlled.

3 Claims, 5 Drawing Figures

VALVE STEM RETAINER

BACKGROUND OF THE INVENTION

1. Field of the Invention

This invention is in the field of valve stem locks for valves of internal combustion engines in which the geometry of a pair of lock segments is controlled with respect to the valve stem so that the segments frictionally resist removal from the valve stem.

2. Description of the Prior Art

Some countries require that trucks and buses be provided with engine brakes in addition to the normal brakes which act on the wheels or axles. Such engine brakes usually involve the use of a throttling valve located within the exhaust line. When such valve is closed, a back pressure builds up very rapidly in the exhaust line, and the effect of back pressure is to provide a significant braking force on the internal combustion engine. The pressurized exhaust line creates an unusual and extreme condition for the engine valve gear. There are extraordinary stresses placed on the entire valve gear of the engine and as a result, excessive vibration can occur between the valve, valve stem locks or keepers, the valve spring retainer and the valve spring. These vibrations can become so substantial that the valve spring and the spring retainer may surge (not be able to remain in a secured position) with respect to the valve stem locks even to the extent of the spring retainer becoming completely dislodged from engagement with the valve stem locks. This unfavorable dynamic condition results from irregular valve movement under the influence of exhaust line pressure, whereby a piston may actually contact the valve causing extreme acceleration thereof which may lead to the spring and spring retainer lagging behind the movement of the valve. Alternatively it is possible for the gas pressure in the exhaust system to act on the valve forcing it open and then releasing it at a time when the valve cannot return positively to seat on the valve operating cam. In either of these instances, the movement of the valve spring and spring retainer may become completely out of phase with movement of the valve so that the spring retainer becomes physically separated from the valve locks. In this extreme condition, parts of the valve retainer assembly built according to prior art, knowledge and practice may actually become dislodged and damage to the engine may result due, for example, to a valve dropping into the combustion area. While it is true that such damage will occur only under very unique and complicated circumstances, the catastrophic nature of the damage which may occur requires that steps be taken to prevent their occurrence.

SUMMARY OF THE INVENTION

The present invention provides a valve stem retainer lock assembly in which the geometry of the component parts is controlled to provide an improved frictional locking engagement between a pair of lock segments and the valve stem. Specifically, I have found that the radius of curvature of each of the lock segments should be less than the radius of curvature of the valve stem and preferably should be greater than about 0.98 times but less than 0.995 times the radius of the valve stem. When so dimensioned, the segments are clamped against the valve stem in tight frictional engagement due to elastically stored strain energy acting as a curved beam while defining a pair of diametrically opposed arcs along the periphery of the stem. In accordance with the present invention, assuming the segments to be centered on said valve stem the ratio of one-half of one of the pairs of arcs to the radius of the valve stem is set at less than 0.1 and preferably greater than 0.04 but less than 0.09. With these parameters, it was observed that a substantially improved locking engagement occurs between the lock segments and the valve stem.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
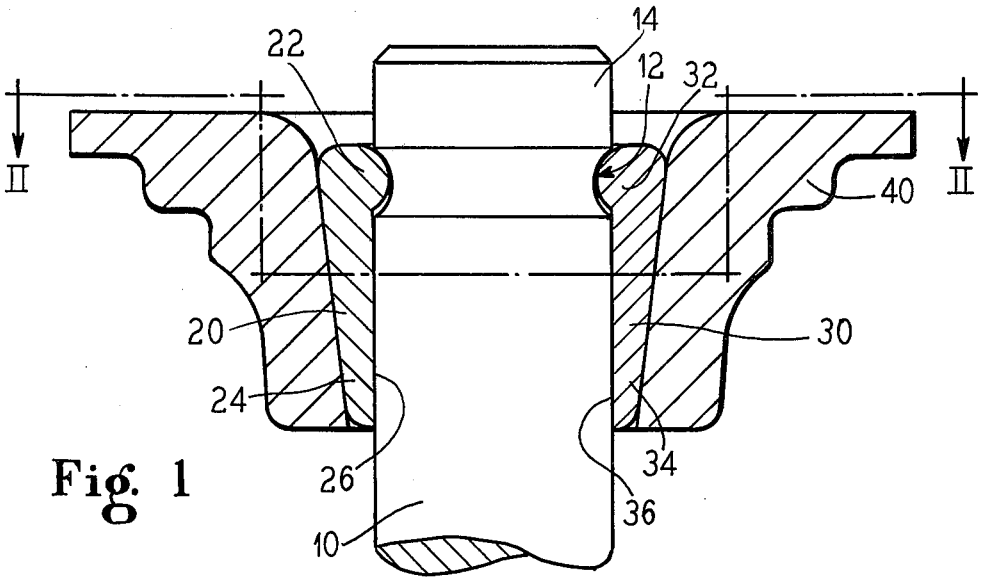
FIG. 1 is a view partly in elevation and partly in cross-section of a valve spring retainer and valve lock assembly produced in accordance with the present invention.

In FIG. 1, a valve stem 10 of a poppet-type engine valve is provided with an annular seating groove 12 near the tip 14 thereof. A pair of identical valve locks 20 and 30 have annular bead portions 22 and 32, respectively, arranged to be seated within the groove 12. The retainer locks 20 and 30 are conventionally made with a generally frusto-conical outer configuration and a tapering wall thickness as best illustrated in FIG. 1. The locks 20 and 30 each include lower portions 24,34 which define substantially semicylindrical surfaces 26,36.

The spring retainer 40 normally maintains the retainer locks 20 and 30 elastically deformed and in contact with the valve stem 10 so that the beads 22 and 32 are seated within the groove 12. In the free condition of the retainer locks 20 and 30, illustrated in FIG. 3 of the drawings, the radius of curvature of the lock segments 20 or 30, identified at $r_2$ in FIGS. 2 and 3 is less than the radius of curvature of the valve stem 10 identified $r_1$ Specifically, I have found that for best results each of the segments 20,30 should have a radius of curvature greater than about 0.98 times but less than about 0.995 times the radius of the circular valve stem 10.

Figure 2:
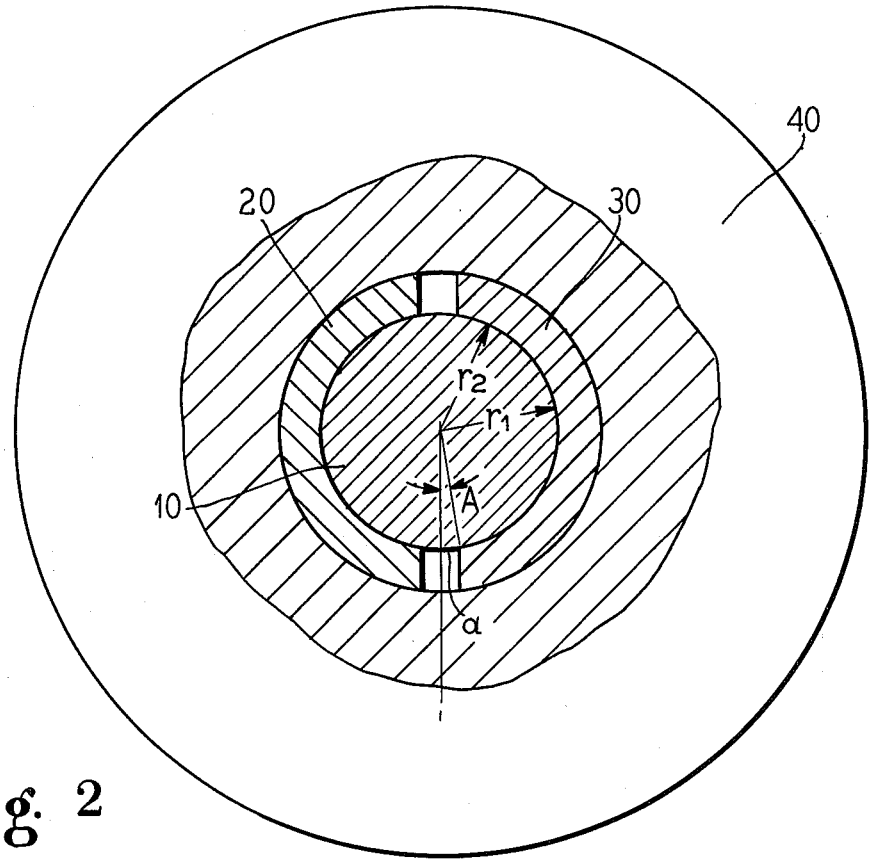
FIG. 2 is a partial sectional view of the assembly shown in FIG. 1, taken along line II—II.

In order to provide the benefits of the present invention, the retainer lock segments 20 and 30 do not, when positioned on the valve stem 10, extend about the complete periphery of the valve stem but instead define, when in the position of FIG. 2, diametrically opposed arcs having a total dimension of four ($a$) as shown in FIG. 2. I have found that the ratio of one-fourth of the total arc, shown as ($a$) and which would be defined mathematically in terms of $r_1$ as $a=r_1$ (rad A) to the radius $r_1$ of the valve stem 10, should be less than about 0.1 and preferably should be greater than 0.04 but less than 0.09.

Figure 4:
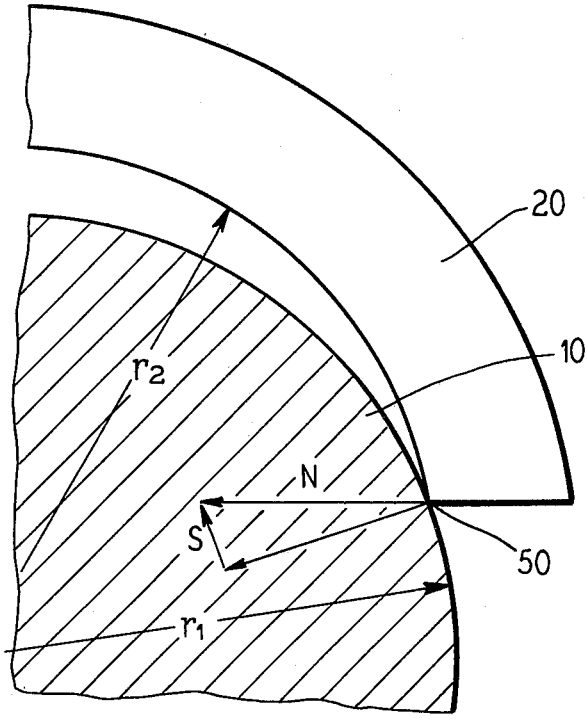
FIG. 4 is a fragmentary view on an enlarged scale illustrating the relationship of radii between the locks and the valve stem.
Figure 5:
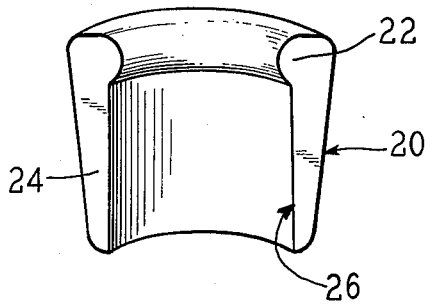
FIG. 5 is a perspective view of a lock segment.

Due to the difference between $r_2$ and $r_1$, it is, of course, necessary to deform the segments 20 and 30 in order to position such segments on the valve stem 10 as shown in FIGS. 1 and 2. By selection of the ratio of radii $r_2$ $r_1$ to produce an arc $a$ within the parameters set forth above, it is possible to design lock segments which adhere to the valve stem 10 by producing a locking friction, force, $s$, (see FIG. 4) which is effective to retain the segments 20 and 30 on the stem 10 without further support. The friction force $s$ is a function of the difference between radii $r_2$ and $r_1$ and the arc dimension $a$. Due to the inequality of free radii $r_2$ and $r_1$, the force $n$ resulting from internal elastic stress in the segment 20, (see FIG. 4), does not pass through the center of the valve stem 10 thereby generating the friction force, $s$, which tends to support the segment 20 on the valve stem 10 independent of any assistance from a spring retainer 40.

Figure 3:
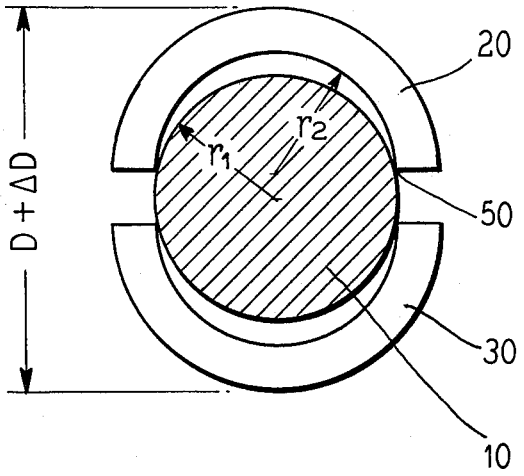
FIG. 3 is a plan view illustrating the relative diameter between the locks and the valve stem prior to installation of the locks on the valve stem.

Referring now to FIG. 3, unassembled lock segments 20 and 30 are shown engaging the valve stem 10 at lines of contact 50 at the maximum extent of retention due to the friction force generated by the internal elastic stress within the segments 20,30 (free diameter of adherence). The free diameter of adherence, $D+D$, shown in FIG. 3, can be calculated from given dimensions for $r_1$, $r_2$ and $a$ as follows:

$$\frac{\Delta D}{2r} = 1 - \sqrt{\left(\frac{r_2}{r_1}\right)^2 + \left(\frac{a}{r_1}\right)^2} + \frac{r_2}{r_1} - 1 - \frac{a}{r_1}$$

The conditions for self-locking of the segments 20,30 appear to be that the ratio of the segment radius, $r_2$, to valve stem stem radius, $r_1$, is less than 1 and the ratio of arc $a$ to valve stem radius, $r_1$, and arc, $a$, to valve stem radius, $r_1$, appear to be as follows:

$0.98 < r_2/r_1 < 0.995$; and $0.04 < a/r_1 < 0.090$

The improved valve lock retainer of the present invention can be made of various materials, but I prefer to use a case hardened mild steel, particularly SAE 1010 as the material for the retainer lock segments. This material is sufficiently flexible and ductile to be resiliently deformed while still being resistant to the various stresses which occur on the retainer lock segments during the operation.

It should be evident that various modifications can be made to the described embodiments without departing from the scope of the present invention.

I claim as my invention:

1. A valve lock retainer assembly comprising a pair of valve retainer lock segments, each of said segments having a radius of curvature less than the radius of curvature of a valve stem about which segments are to be received, at least one of said segments being deformed into mating engagement with said valve stem and providing frictional engagement as a result of elastically stored strain energy in said segment, each of said segments having a radius of curvature greater than 0.98 times but less than 0.995 times the radius of said valve stem.

2. The valve lock retainer assembly of claim 1 in which each segment when installed on said valve stem circumscribes an arc of less than 180° by a lesser arc and one-half of the ratio of the lesser arc to the radius of the valve stem is greater than 0.04 but less than 0.090.

3. The valve lock retainer of claim 1 in which said segments are composed of a case hardened mild steel.

* * * * *